US006174493B1

(12) United States Patent
Asbury

(10) Patent No.: US 6,174,493 B1
(45) Date of Patent: Jan. 16, 2001

(54) POROUS BERYLLIUM

(75) Inventor: Joseph J. Asbury, Knoxville, TN (US)

(73) Assignee: The United States of America as represented by the United States Department of Energy, Washington, DC (US)

( * ) Notice: Under 35 U.S.C. 154(b), the term of this patent shall be extended for 0 days.

(21) Appl. No.: 04/690,701

(22) Filed: Dec. 6, 1967

(51) Int. Cl.[7] ..... B22F 1/04; B22F 1/00
(52) U.S. Cl. ..... 419/2; 419/38
(58) Field of Search ..... 75/200, 211, 222, 75/223

(56) References Cited

U.S. PATENT DOCUMENTS 3,305,358 * 2/1967 Lirones ..... 419/2
3,410,684 * 11/1968 Printz ..... 419/2
3,433,632 * 3/1969 Elbert et al. ..... 419/38

* cited by examiner

*Primary Examiner*—Charles T. Jordan
*Assistant Examiner*—Jack Keith
(74) *Attorney, Agent, or Firm*—Emily G. Schneider; William R. Moser; Paul A. Gottlieb

(57) ABSTRACT

Porous articles consisting virtually entirely of beryllium metal are prepared by using iodine as a fugitive pore former. An admixture of beryllium powder and crystalline iodine is pressed into a compact and then heated in vacuum at a temperature of about 100° C. to sublime the iodine. The compact is thereafter sintered at a temperature of about 1000° C.

5 Claims, No Drawings

POROUS BERYLLIUM

The present invention relates generally to high-purity, low-density beryllium articles and more particularly to uniformly porous compacts consisting essentially entirely of beryllium metal and the preparation of such compacts by using crystalline iodine as a fugitive pore former. This invention was made in the course of, or under, a contract with the U.S. Atomic Energy Commission.

Beryllium metal has enjoyed considerable success as a structural material because of its high temperature strength, low weight, and desirable nuclear properties. In applications where tensile strength is not of primary importance the weight of the beryllium structure can be even further reduced by employing porous beryllium, By using porous beryllium the density of the structure can be decreased from a normal bulk density of about 1.85 gm/cc down to about 0.30 gm/cc, so as to not only provide a significant weight reduction, but also a substantial monetary savings due to the use of less beryllium metal in the structure. Porous beryllium structures can also be advantageously employed as conduits for transporting gases and liquids at various temperatures, as fluid filters, in transpiration cooling applications, etc.

While porous beryllium as produced by known techniques can be used in some applications, it suffers some drawbacks and shortcomings which render such porous beryllium unsuitable for many other applications. For example, porous beryllium products prepared by using camphor as a pore former have not been found to be satisfactory from a high purity standpoint since excessive quantities of camphor remain in the beryllium product after completion of the camphor leaching operation, Another drawback to the use of camphor as a pore former is due to the formation of laminations in the beryllium product during pressing and sintering operations. Zinc has also been considered as a pore former for preparing porous beryllium, but, like camphor, has been found to result in somewhat unsuitable porous beryllium products since the zinc contaminates the porous beryllium and the zinc vapors produced during the volatilization of the zinc for forming the beryllium product cause considerable corrosion of the furnace interior.

It is the aim of the present invention to obviate or minimize the above and other shortcomings or drawbacks by providing a method for preparing porous beryllium compacts which are particularly characterized by high purities and low, uniform densities. These novel beryllium compacts are produced by forming a mixture of beryllium powder and crystalline iodine and then die forming and isostatically pressing this mixture of particulate materials into a compact. The iodine functions as the pore forming material and is readily removed from the compact by heating the latter under vacuum to sublime the iodine and trapping the iodine vapors in a cold trap. The compact is then sintered to provide a product of more uniform density and integrity.

An object of the present invention is to provide porous beryllium products of high purity and low, uniform density.

Another object of the present invention is to provide a new and improved method for preparing porous beryllium products which are virtually free of contaminants and exhibit substantially uniform densities.

A still further object of the present invention is to provide a method for preparing porous beryllium compacts by forming such compacts of an admixture of beryllium powder and crystalline iodine, subliming the iodine from the compact, sintering the compact, and thereafter removing iodine values from the compact by employing an iodine solvent.

Other and further objects of the invention will be obvious upon an understanding of the illustrative features about to be described, or will be indicated in the appended claims, and various advantages not referred to herein will occur to one skilled in the art upon employment of the invention in practice.

As briefly mentioned above, the present invention contemplates the preparation of porous beryllium products which enjoy high purity, together with low and uniform densities. It has been found that iodine provides a desirable fugitive pore former for fabricating porous beryllium structures due to the fact that iodine is a crystalline solid at room temperature and sublimes or volatilizes at relatively low temperatures, e.g., about 100° C. Also, iodine is desirable as a pore former for preparing porous beryllium since any iodine contamination present in the beryllium compact after the sublimation step is most likely in the form of beryllium iodide on the surfaces of the pores and can be virtually entirely removed by employing an iodine solvent such as acetone or ethyl alcohol.

In practicing the present invention a porous beryllium product may be prepared by mixing together selected quantities of beryllium powder and pure crystalline iodine. The beryllium powder is preferably in a size range of about 74 to 44 microns (−200 to +325 mesh) or less and of a high purity such as the commercially available 99.6 per cent pure beryllium metal. The crystalline iodine is preferably in a size range of about 177 to 74 microns (−80 to +200 mesh) or less. The ratio of beryllium powder to iodine is dependent upon the porosity or density of the compact desired, with the percentage of iodine increasing with decreasing density. After thoroughly mixing the beryllium powder and the particulate iodine, the mixture is die formed and then isostatically pressed at a pressure sufficient to form a compact exhibiting adequate integrity for maintaining its shape during subsequent handling. The compact is placed in a suitable heating chamber or furnace under vacuum of a pressure corresponding to about $1\times10^{-4}$ mm of mercury or better and then heated at a temperature of about 100° C. for a duration sufficient to sublime virtually ail the free iodine in the compact. Normally, a period of about 24 hours is sufficient to volatilize the free iodine in the compact. During this heating period the iodine driven from the compact in vapor form is readily trapped in a cold trap cooled in any suitable manner such as by liquid nitrogen. The sublimation of the iodine under the influence of vacuum assures that the compact remains free of impurities such as carbons oxides, nitrides, etc.

After driving the iodine from the compact the latter is subjected to a sintering operation for increasing the integrity of the structure by diffusion bonding together adjacent beryllium particles and improving the density of the compact by making it more uniform. In order to assure that the beryllium compact maintains its low density, the sintering operation preferably takes place at temperatures less than about 1000 C. since above this temperature increased densification occurs. Satisfactory results have been achieved by sintering the compact in a suitable furnace under vacuum at a temperature in a range of about 900°–950° C. for a period of 4 to 5 hours. Longer sintering times may be employed for larger compacts. However, if desired, the compact may be subjected to temperatures higher than 1000° C. during the last part of the sintering operation to increase the integrity of the compact without adversely affecting the density of the compact. For example, the sintering may be accomplished at a temperature of 900° C. for a period of about 4.5 hours and then at a temperature of about 1200° C. for a period of about 0.5 hour.

The compact may contain some contamination in the form of iodine values after completing the sublimation and sintering steps. However, since this contamination is apparently present in the compact in the form of beryllium iodide on the surfaces of the pores, it is readily decreased to a level corresponding to an iodine content of less than 10 parts per million. This decrease or removal of the iodine from the compact may be accomplished by refluxing the compact with a suitable iodine solvent, e.g., boiling ethyl alcohol or acetone, as will be described in greater detail below.

The porous beryllium compacts prepared in accordance with the present invention contain no laminations, are of essentially uniform density, and are virtually entirely formed of beryllium since any contamination caused by the iodine pore former can be readily reduced to less than 10 ppm and since contaminants from other sources, e.g., the atmosphere, are prevented from influencing the purity of the product. The bulk density of the sintered compacts may be easily varied from a low of about 0.3 gm/cc up to a density approaching theoretical density of approximately 1.85 gm/cc by using different amounts of the particulate iodine pore former. The sintered compacts produced by practicing the present invention have been found to possess a gradient density of less than about ±5 per cent. Also, the pore size of the compact may be varied by increasing or decreasing the screen size or particle size of the crystalline iodine.

In order to provide a better understanding of the present invention an example of a typical operation used for the preparation of a porous beryllium compact of about 2.5 inches in length, 2 inches in diameter, and of a density of approximately 0.55 gm/cc is set forth below.

EXAMPLE

A compact of porous beryllium metal was produced by milling 475 grams of pure crystalline iodine for 30 minutes using small tungsten rods. One hundred grams of beryllium powder (−200 to +325 mesh, 99.6% pure) was added to the iodine and milled for two hours for preparing a mixture of the beryllium powder and crystalline iodine. The mixture was die formed into a cylindrical configuration by a loading of 5,000 psi and then isostatically pressed at 30,000 psi to form the compact, The compact was placed in a furnace under vacuum and heated at 100° C. for 24 hours to remove the iodine. The iodine sublimed from the compact was trapped in a cold trap, cooled by liquid nitrogen, After this 24-hour heating period the temperature was increased to 900° C. for 4.5 hours and then further increased to 1200° C. for 0.5 hour for sintering the compact. The entire heating and sintering operation was accomplished under vacuum. Iodine values remaining in the compact including an iodine value in the form of beryllium iodide on the surface of the pores were removed by refluxing the compact in acetone. The sintered compact was placed on a support in a flask above an acetone bath. A condenser was fitted to the flask and, after heating the flask, pure acetone contacted the compact and dissolved the iodine values. The refluxing-with-acetone operation was continued for 48 hours. At the end of this time the iodine content in the compact was determined to be less than 10 ppm by X-ray fluorescence analysis.

It will be seen that the present invention sets forth a significant improvement in preparing porous beryllium compacts whereby the compacts enjoy essentially uniform density and porosity and are formed of virtually beryllium metal since the iodine values remaining in the prepared compact amount to less than 10 ppm and since other contaminants are prevented from contaminating the compact during its preparation.

As various changes may be made in the method and arrangement of the method steps herein without departing from the spirit and scope of the invention and without sacrificing any of its advantages, it is to be understood that all matter herein is to be interpreted as illustrative and not in a limiting sense.

What is claimed is:

1. A method of preparing a porous beryllium product, comprising the steps of admixing beryllium powder with particulate crystalline iodine, forming the admixture into a compact, confining the compact in an evacuated space, heating the compact to a temperature sufficient to sublime the iodine, and thereafter heating the compact to a temperature sufficient to sinter the beryllium powder.

2. The method claimed in claim 1, including the additional step of contacting the compact subsequent to the sintering thereof with an iodine solvent for removing iodine values from the compact.

3. The method claimed in claim 2, wherein the compact is contacted by the iodine solvent for a duration sufficient to provide a compact containing iodine values amounting to less than 10 parts per million of beryllium metal.

4. The method claimed in claim 1, wherein the temperature sufficient to sublime the iodine in the compact is about 100° C., said compact is maintained at about 100° C. for a duration sufficient to remove essentially all the free iodine from the compact, and wherein the iodine sublimed from the compact is maintained remote to the compact.

5. The method claimed in claim 1, wherein the temperature sufficient to sinter beryllium powder of the compact is in a range of about 900°–1200° C., the sintering of the compact is effected in an evacuated space, the compact is maintained at at least one temperature in said range for a duration sufficient to join adjacently disposed beryllium particulates, and wherein the compact is maintained at a temperature in said range corresponding to less than 1000° C. for at least a major portion of said duration.

* * * * *